US009113758B1

(12) United States Patent
O'Brien

(10) Patent No.: US 9,113,758 B1
(45) Date of Patent: Aug. 25, 2015

(54) TOILET CLEANING BRUSH DEVICE

(71) Applicant: Martin J. O'Brien, Chicago, IL (US)

(72) Inventor: Martin J. O'Brien, Chicago, IL (US)

( * ) Notice: Subject to any disclaimer, the term of this patent is extended or adjusted under 35 U.S.C. 154(b) by 0 days.

(21) Appl. No.: 14/132,156

(22) Filed: Dec. 18, 2013

(51) Int. Cl.
*A47K 11/10* (2006.01)

(52) U.S. Cl.
CPC ..... *A47K 11/10* (2013.01); *A46B 2200/304* (2013.01)

(58) Field of Classification Search
CPC ..... A47K 11/10; A46B 5/005; A46B 7/023; A46B 2200/304
USPC ..... 15/201, 172, 106, 159.1, 160
See application file for complete search history.

(56) References Cited

U.S. PATENT DOCUMENTS

| | | | | |
|---|---|---|---|---|
| 2,816,305 | A * | 12/1957 | Kravitt | 15/106 |
| 5,592,711 | A * | 1/1997 | Maier et al. | 15/106 |
| 5,878,459 | A | 3/1999 | McParland | |
| 5,984,555 | A | 11/1999 | Samad | |
| D458,426 | S | 6/2002 | Kovach | |
| 6,880,197 | B2 | 4/2005 | Katz et al. | |
| 7,473,046 | B2 | 1/2009 | Kraus et al. | |
| D643,630 | S | 8/2011 | Raven | |
| 2004/0141794 | A1* | 7/2004 | Slaboden | 401/88 |
| 2005/0125922 | A1 | 6/2005 | Szarawarski | |
| 2007/0056127 | A1* | 3/2007 | Haviv | 15/105 |
| 2011/0297174 | A1* | 12/2011 | Ornoski et al. | 132/218 |

* cited by examiner

*Primary Examiner* — Laura C Guidotti

(57) ABSTRACT

A toilet cleaning brush device facilitates cleaning of a toilet by providing an extendable brush section includes a handle having a top end and a bottom end. A head is coupled to the bottom end of the handle. Each of a plurality of bristles is coupled to and extends outwardly from the head. An extendable section of the head is selectively extendable, from a main section of the head wherein the extendable section extends outwardly from the main section parallel to a longitudinal axis of the handle.

7 Claims, 3 Drawing Sheets

TOILET CLEANING BRUSH DEVICE

BACKGROUND OF THE DISCLOSURE

Field of the Disclosure

The disclosure relates to brush devices and more particularly pertains to a new brush device for facilitate cleaning of a toilet by providing an extendable brush section.

SUMMARY OF THE DISCLOSURE

An embodiment of the disclosure meets the needs presented above by generally comprising a handle having a top end and a bottom end. A head is coupled to the bottom end of the handle. Each of a plurality of bristles is coupled to and extends outwardly from the head. An extendable section of the head is selectively extendable from a main section of the head wherein the extendable section extends outwardly from the main section parallel to a longitudinal axis of the handle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
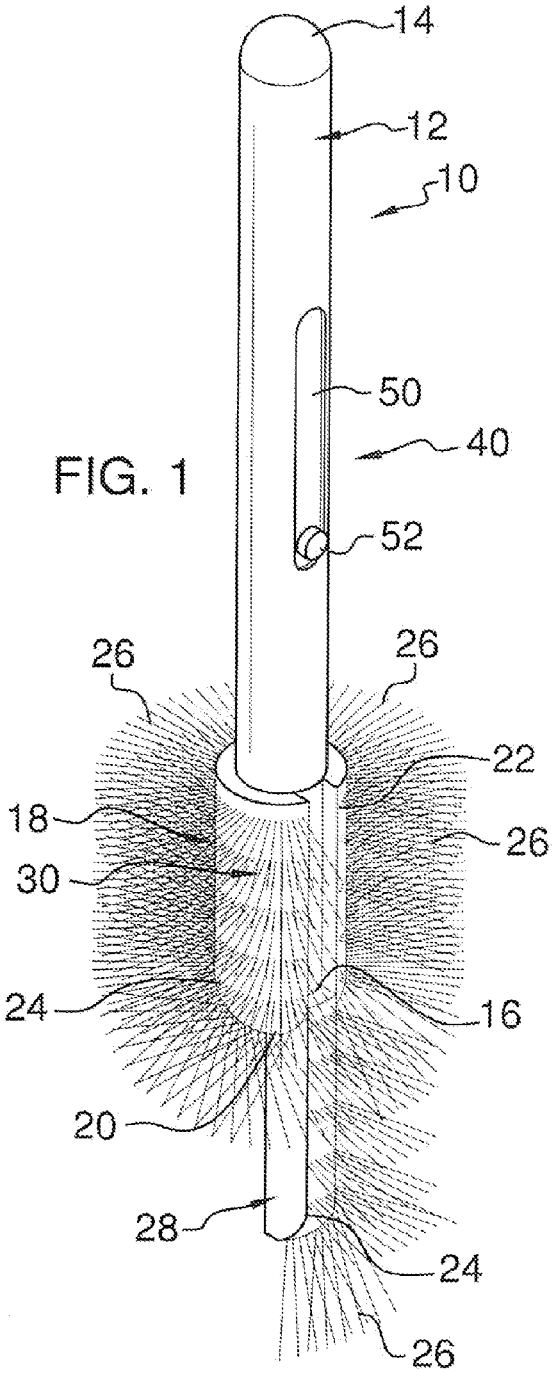
FIG. 1 is a top front side perspective view of a toilet cleaning brush device according to an embodiment of the disclosure in an extended position.
Figure 2:
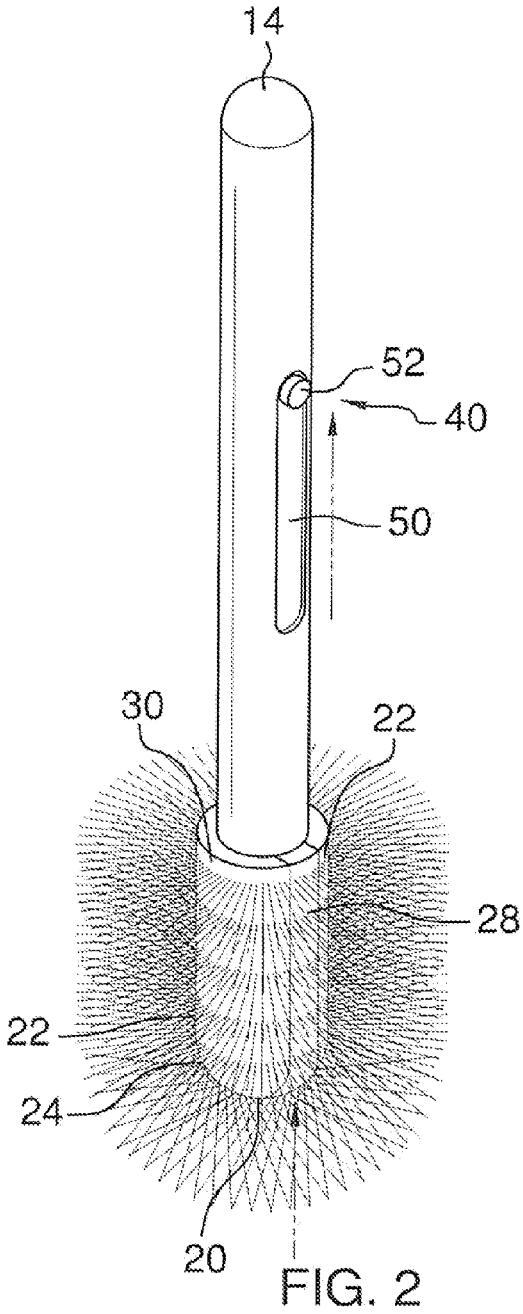
FIG. 2 is a top front side perspective view of an embodiment of the disclosure in a retracted position.
Figure 3:
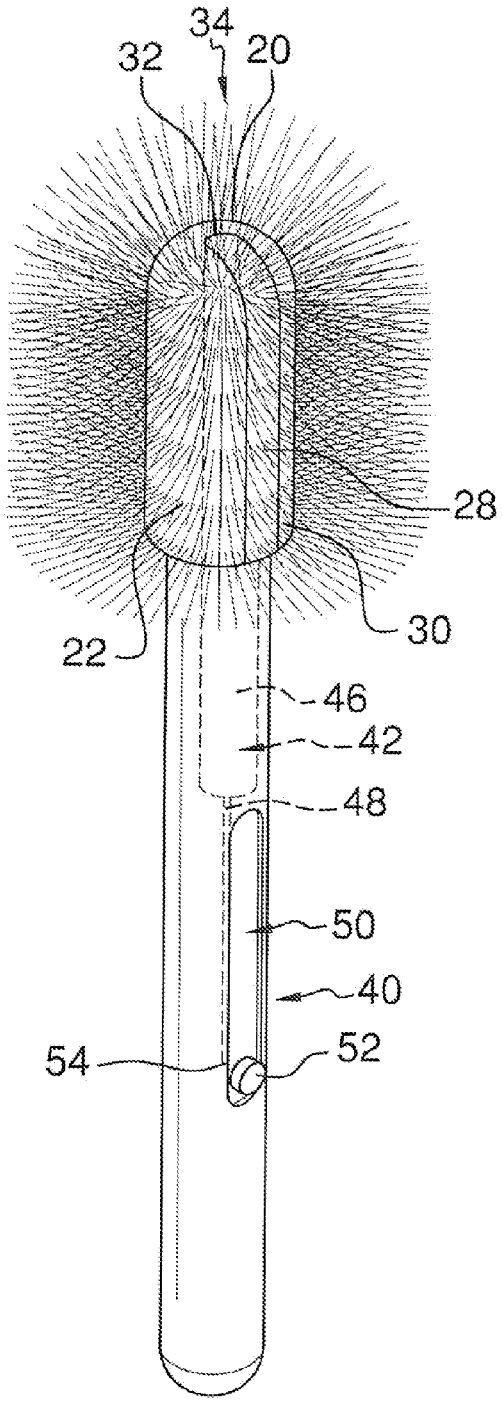
FIG. 3 is a bottom front side perspective view of an embodiment of the disclosure in the retracted position.
Figure 4:
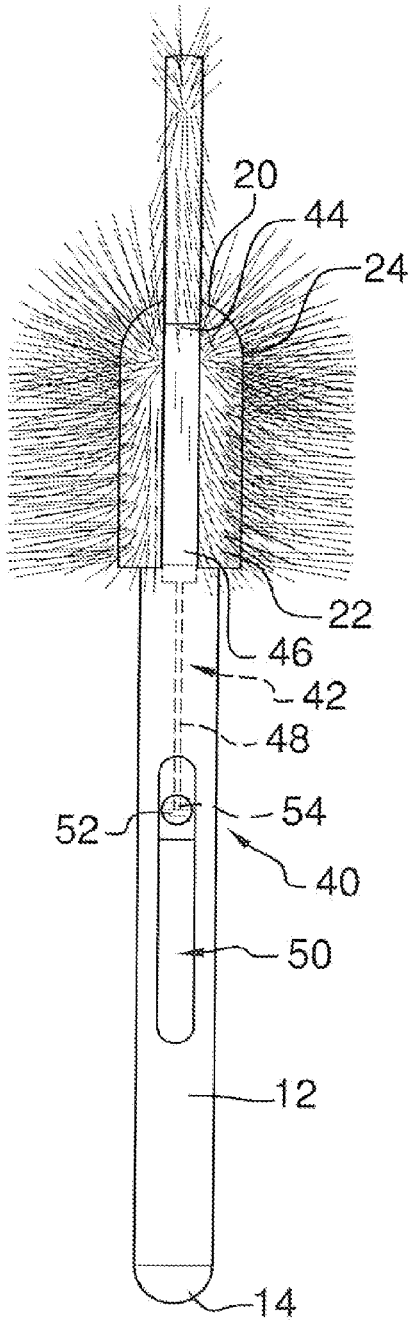
FIG. 4 is an inverted front view of an embodiment of the disclosure in the extended position.
Figure 5:
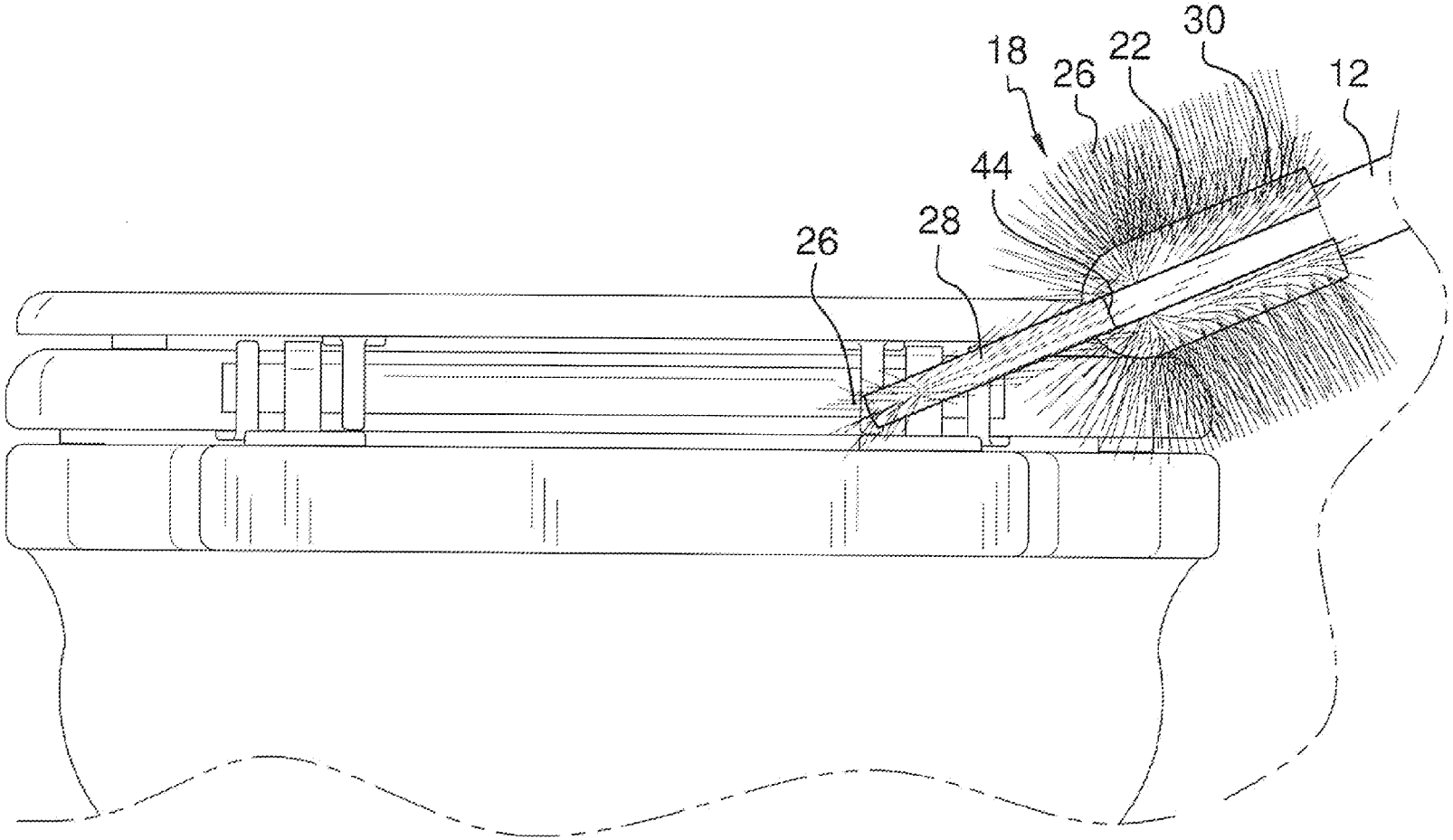
FIG. 5 is a front perspective view of an embodiment of the disclosure in use.

With reference now to the drawings, and in particular to FIG. 1 through 5 thereof, a new brush device embodying the principles and concepts of an embodiment of the disclosure and generally designated by the reference numeral 10 will be described.

As best illustrated in FIGS. 1 through 5, the toilet cleaning brush device 10 generally comprises a handle 12 having a top end 14 and a bottom end 16. A head 18 is coupled to the bottom end 16 of the handle 12. The head 18 has a hemispherical cap portion 20 and a tubular perimeter wall 22 extending from a circumferential edge 24 of the cap portion 20. Each of a plurality of bristles 26 is coupled to and extends outwardly from the head 18. The bristles 26 extend radially outward from the cap portion 20 and the perimeter wall 22 of the head 18.

An extendable section 28 of the head 18 is selectively extendable from a main section 30 of the head 18. The extendable section 28 extends outwardly from the main section 30 parallel to a longitudinal axis of the handle 12. The extendable section 28 of the head 18 is elongated and has a first end 32 positioned at a center 34 of the cap portion 20. The extendable section 28 of the head 18 has a pair of opposed parallel longitudinal sides 36 extending away from the first end 32 of the extendable section 28 towards a second end 38 of the extendable section 28. Each of the opposed parallel longitudinal sides 36 of the extendable section 28 may extend a full length of the perimeter wall 22 parallel to the longitudinal axis of the head 18.

A lever 40 is coupled to the handle 12 and the extendable section 28 of the head 18. The extendable section 28 is extendable from the main section 30 of the head 18 by manipulation of the lever 40. The lever 40 may comprise a rod 42 extending through the handle 12. The rod 42 has a first end 44 coupled to the extendable section 28 of the head 18. The rod 42 may comprise a dowel 46 and a wire 48. The dowel 46 is linearly aligned with the wire 48. The dowel 46 is coupled to and extends from the head 18 and the wire 48 is coupled to and extends from the lever 40.

A slot 50 extends through the handle 12. The slot 50 extends parallel to the longitudinal axis of the handle 12. A button 52 is coupled to the handle 12 and positioned in the slot 50. A second end 54 of the rod 42 is coupled to the button 52 wherein manipulation of the button 52 slides the rod 42 within the handle 12 such that the extendable section 28 of the head 18 is selectively extended from the main section 30 of the head 18.

In use, the device 10 may be utilized in the same manner as a conventional toilet brush. The button 52 is selectively manipulated to extend the extendable section 28 of the head 18 when desired to provide bristles 26 extending from a single side of the extendable section 28, which is also relatively smaller than the entirety of the head 18. Thus, the extendable section 28 facilitates cleaning of additional portions of a toilet, bathroom, tub, sink, or the like which would not be efficiently or easily cleaned using the head 18 when the extendable section 28 is not extended.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet cleaning brush device comprising:

a handle having a top end and a bottom end;

a head coupled to said bottom end of said handle;

a plurality of bristles coupled to and extending outwardly from said head; and an extendable section of said head being selectively extendable from a main section of said head wherein said extendable section extends outwardly from said main section parallel to a longitudinal axis of said handle;

said head having a hemispherical cap portion and a tubular perimeter wall extending from a circumferential edge of said cap portion; and said extendable section of said head being elongated and having a first end positioned at a center of said cap portion, said extendable section of said head having a pair of opposed parallel longitudinal sides extending away from said first end of said extendable section towards a second end of said extendable section, each of said opposed parallel longitudinal sides of said extendable section extending a full length of said perimeter wall parallel to said longitudinal axis of said head.

2. The device of claim 1, further comprising a lever coupled to said handle and said extendable section of said head, said extendable section being extendable from said head by manipulation of said lever.

3. The device of claim 2, further comprising said lever comprising a rod extending through said handle, said rod having a first end coupled to said extendable section of said head.

4. The device of claim 3, further comprising:

a slot extending through said handle, said slot extending parallel to said longitudinal axis of said handle;

a button coupled to said handle, said button being positioned in said slot; and a second end of said rod being coupled to said button wherein manipulation of said button slides said rod within said handle such that said extendable section of said head is selectively extended from said head.

5. The device of claim 3, further comprising said rod comprising a dowel and a wire, said dowel being linearly aligned with said wire, said dowel being coupled to and extending from said head, said wire being coupled to and extending from said lever.

6. The device of claim 1, further comprising said bristles extending radially outward from said cap portion and said perimeter wall of said head.

7. A toilet cleaning brush device comprising:

a handle having a top end and a bottom end;

a head coupled to said bottom end of said handle, said head having a hemispherical cap portion and a tubular perimeter wall extending from a circumferential edge of said cap portion;

a plurality of bristles coupled to and extending outwardly from said head, said bristles extending radially outward from said cap portion and said perimeter wall of said head;

an extendable section of said head being selectively extendable from a main section of said head wherein said extendable section extends outwardly from said main section parallel to a longitudinal axis of said handle, said extendable section of said head being elongated and having a first end positioned at a center of said cap portion, said extendable section of said head having a pair of opposed parallel longitudinal sides extending away from said first end of said extendable section towards a second end of said extendable section, each of said opposed parallel longitudinal sides of said extendable section extending a full length of said perimeter wall parallel to said longitudinal axis of said head;

a lever coupled to said handle and said extendable section of said head, said extendable section being extendable from said head by manipulation of said lever, said lever comprising a rod extending through said handle, said rod having a first end coupled to said extendable section of said head, said rod comprising a dowel and a wire, said dowel being linearly aligned with said wire, said dowel being coupled to and extending from said head, said wire being coupled to and extending from said lever;

a slot extending through said handle, said slot extending parallel to said longitudinal axis of said handle;

a button coupled to said handle, said button being positioned in said slot; and a second end of said rod being coupled to said button wherein manipulation of said button slides said rod within said handle such that said extendable section of said head is selectively extended from said head.

* * * * *